US005997349A

United States Patent [19]

Yoshioka

[11] Patent Number: 5,997,349

[45] Date of Patent: Dec. 7, 1999

[54] MULTI-POLAR SHIELDED CONNECTOR AND MATING SHIELDED CONNECTOR

[75] Inventor: Nobuaki Yoshioka, Shizuoka-ken, Japan

[73] Assignee: Yazaki Corporation, Tokyo, Japan

[21] Appl. No.: 09/239,715

[22] Filed: Jan. 29, 1999

[30] Foreign Application Priority Data

Jan. 30, 1998 [JP] Japan ..... 10-019827

[51] Int. Cl.[6] ..... H01R 9/05; H01R 17/04

[52] U.S. Cl. ..... 439/579; 439/610

[58] Field of Search ..... 439/579, 578, 439/497, 610

[56] References Cited

U.S. PATENT DOCUMENTS

| | | | |
|---|---|---|---|
| 4,830,628 | 5/1989 | Dyson et al. | 439/584 |
| 5,618,202 | 4/1997 | Okuyama et al. | 439/497 |
| 5,823,825 | 10/1998 | Murphy | 439/610 |
| 5,855,493 | 1/1999 | Shelly | 439/465 |

FOREIGN PATENT DOCUMENTS

| | | |
|---|---|---|
| 8-138798 | 5/1996 | Japan . |
| 8-153555 | 6/1996 | Japan . |
| 8-250219 | 9/1996 | Japan . |
| 8-264238 | 10/1996 | Japan . |
| 8-330026 | 12/1996 | Japan . |

*Primary Examiner*—Neil Abrams
*Assistant Examiner*—Chandrika Prasad
*Attorney, Agent, or Firm*—Finnegan, Henderson, Farabow, Garrett & Dunner, L.L.P.

[57] ABSTRACT

A multi-polar shielded connector (15) includes a housing (24) having a plurality of accommodating portions (23) where end portions (17) of a plurality of shielded wires (16) together with terminals 18 are accommodated, respectively, a shielding member (25) provided in the housing (24), for covering the plurality of accommodating portions (23) in a lump to shield the end portions (17) of the shielded wires (16) and the terminals (18) connected to the end portions (17), a plurality of shield contact members (26) conductively contacting with respective braid wires (21) of the shielded wires 16, respectively, and a conductive block (27) assembled in the housing (24), for conductively connecting with the shielding member (25) and conductively connecting with the shielding member (25) to conductively connect the shielding member (25) and the shield contact members (26) to each other. Accordingly, in a multi-polar shielded connector, the number of component parts can be reduced, the structure can be simplified, a size reduction can be made possible, and manufacturing costs can be decreased.

10 Claims, 14 Drawing Sheets

MULTI-POLAR SHIELDED CONNECTOR AND MATING SHIELDED CONNECTOR

BACKGROUND OF THE INVENTION

1. Field of the Invention

The present invention relates to a multi-polar shielded connector in which a plurality of shielded wires are accommodated.

2. Description of Relevant Art

There has been disclosed shielded connectors in Japanese Patent Application Laid-Open Publication Nos. 8-138798, 8-153555, 8-250219, 8-264238, and 8-3300226 (which have previously been filed by the present applicant).

Such a shielded connector is provided with an inner housing having an accommodating portion in which a terminal connected to an end portion of a shielded wire together with the end portion is accommodated, an outer housing formed integrally with the inner housing inside thereof, a cylindrical metallic shell (shielding member) disposed between the inner housing and the outer housing so as to cover the accommodating portion, and a shield contactor for conductively connecting a braid wire of the shielded wire and the metallic shell. The connecter has a rubber plug for water-proofing between the inner wall of the outer housing and the shielded wire, and a retainer for preventing the rubber plug from falling off from the outer housing.

In such a shielded connector, the end portion of the shielded wire and the terminal connected to the end portion are electromagnetically shielded from each other by the metallic shell conductively connected to the braid wire of the shielded wire via the shield contactor. Also, the metallic shell is connected to a metallic shell of a mating connector fitted thereto to be grounded to an equipment and the like.

In a case of a structure having an end portion of one shielded wire and a terminal connected to the end portion, as the above shielded connector structure, it is easy to effect electromagnetic shield by covering the whole of one accommodation portion with a metallic shell. However, in a case of a shielded connector (multi-polar connector) having a plurality of accommodating portions each accommodating one of end portions of many shielded wires and a terminal connected to the one, covering the accommodating portions with respective metallic shells requires an increased number of component parts and an unnecessarily large sized shielded connector having a space for arranging the metallic shells covering the respective accommodating portions.

Also, the structures of the inner housing and the outer housing become complicated due to the arrangement of the plurality of metallic shells.

Further, in addition to connecting portions for connecting the plurality of metallic shells and braid wires of the respective shielded wires, connecting structure for connecting the respective metallic shells among them and connecting structure for connecting the respective metallic shells to metallic shells of a mating connector are also required, which results in a complicated structure.

SUMMARY OF THE INVENTION

The present invention has been achieved with such points in view.

It therefore is an object of the present invention to provide a multi-polar shielded connector with a decreased number of component parts, with a simplified structure, permitting a small sized structure, permitting reduction in manufacturing costs.

To achieve the object, a first aspect of the invention provides a multi-polar shielded connector where a plurality of shielded wires each comprising a core wire portion comprising a conductor, an insulating inner cover covering the core wire portion, a braid wire disposed around the insulating inner cover, and an insulating outer cover disposed around the braid wire for covering the core wire portion, the insulating inner cover, and the braid wire, and end portions of the plurality to shield wires together with terminals connected to the end portions of the plurality of shielded wires are accommodated, comprising: a housing having a plurality of accommodating portions in which the end portions of the plurality of shielded wires together with the terminals are accommodated respectively; a shielding member provided in the housing and covering the plurality of accommodating portions as a whole to shield the end portions of the shielded wires and the terminals connected to the end portions; a plurality of shield contact members conductively contacting the respective braid wires of the shielded wires; and a conductive block assembled in the housing to conductively connect with the shielding member and to conductively connect with the shield contact members to have the shielding member and the shield contact members conductive to each other.

According to the first aspect, since a plurality of accommodating portions accommodating end portions of a plurality of shielded wires and terminals connected to the end portions are covered as a whole by a shielding member, it is unnecessary to cover the accommodating portions with shielding members such as metallic shells for each accommodating portion. Accordingly, it is possible to reduce the number of component parts. Also, a space for covering the respective accommodating portions with the respective shielding members such as metallic shells is not required, which results in a simplified structure. Further, a plurality of shielding member such as metallic shells are unnecessary, which permits size-reduction of the shielded connector.

Accordingly, the plurality of shield contact members connected to the braid wires of the respective shielded wires and the conducting block are conductively connected to each other by the shielding member, so that the respective shield contact members can be conductively connected to the shielding member in a lump and the plurality of shield contact members can be grounded in a lump by grounding the shielding member. As a result, the number of conductively connected portions are reduced, which results in a simple structure.

A second aspect of the invention provides a multi-polar shielded connector according to the first aspect, wherein the housing comprises a cylindrical outer housing, and an inner housing formed integrally with the outer housing and having a plurality of the accommodating portions inside the inner housing, each of the accommodating portions is formed with an end portion accommodating portion for accommodating the end portion of each shielded wire and a terminal accommodating portion for accommodating the terminal connected to the end portion of each shielded wire, and a braid wire connection accommodating portion formed in the outer housing at a side opposing the terminal accommodating portion via the end portion accommodating portion, where the shield contact members and the braid wires of the shielded wires are connected to each other.

According to the second aspect, end portions of a plurality of shielded wires are accommodated in end portion accommodating portions of in inner housing and terminals connected to the end portions are accommodated in terminal accommodating portions thereof, respectively. Also, shield contact members connected to braid wires of the respective shielded wires are accommodated in a braid wire connection accommodating portion.

Accordingly, the respective end portion accommodating portions and the respective terminal accommodating portions are covered with the shielding member in a lump, so that the end portions of the respective shielded wires and the terminals connected to the end portions are electromagnetically shielded by the shielding member in a lump.

Also, the shielding member can be conductively connected to a plurality of shield contact members, which are conductively connected to the braid wires of the respective shielded wires, by a conductive block in a lump.

A third aspect of the invention provides a multi-polar shielded connector according to the second aspect, wherein the shielding member comprises a cylindrical body disposed between the outer housing and the inner housing, for covering the end portion accommodating portions and the terminal accommodating portions, and a resilient contacting piece provided at one side of the cylindrical body, for resiliently abutting against the conductive block to conductively connect thereto.

According to the third aspect, the respective end portion accommodating portions and the respective terminal accommodating portions are covered with a cylindrical body in a lump, and end portions of a plurality of shielded wires and terminals connected to the end portions are electromagnetically shielded.

Also, a plurality of shield contact members connected to respective braid wire of the plurality of shielded wires are conductively connected to one conductive block, and they are conductively connected to the shielding member in a lump.

A fourth aspect of the invention provides a multi-polar shielded connector according to the third aspect, wherein the conductive block comprises a block body mounted to an opening of the outer housing positioned at the side of the braid wire connection accommodating portion and having a plurality of insertion holes through which the shielded wires drawn out of the respective accommodating portions pass, an outer peripheral connecting portion formed integrally with the block body against which the resilient contacting piece resiliently abuts to conductively connect with the shielding member, and inner peripheral connecting portions provided on inner walls of the insertion holes to conductively connect with the shield contact members.

According to the fourth aspect, respective shield contact members connected to respective braid wires of a plurality of shielded wires are conductively connected to inner peripheral connecting portions of insertion holes of a conductive block, respectively. Respective shield contact members are conductively connected to a shielding member in a lump by the shielding member coductively connecting with an outer peripheral connecting portion of the conductive block.

A fifth aspect of the invention provides a multi-polar shielded connector, wherein each of the shield contact members comprises a conductive contactor pipe inserted between the insulating inner cover and the braid wire of the shielded wire, and a shield contactor having, at one side, a braid wire connecting end which is fitted on the braid wire to hold the braid wire between the contactor pipe and the shield contactor and having, at the other side, a conductive block connecting end which conductively contacts with the inner peripheral connecting portion of the conductive block.

According to the fifth aspect, contactor pipes are inserted between braid wires and insulating inner covers of a plurality of shielded wires, respectively, and shield contactors are fitted on the braid wires, respectively, so that the braid wires are held between the contactor pipes and the shield contactors to effect conductive connection. Also, the respective shield contactors are connected to inner peripheral connecting portions of a conductive block, respectively, so that the respective shield contactors are conductively connected in a lump to a shielding member at the conductive block.

A sixth aspect of the invention provides a multi-polar shielded connector, wherein a retainer for preventing the conductive block assembled in the outer housing from falling off from the outer housing is retained at an opening end portion of the outer housing positioned at a side of the braid wire connection accommodating portion.

According to the sixth aspect, a conductive block is prevented from falling off from an outer housing by retaining a retainer at an opening end portion of the outer housing positioned at a side of the braid wire connection accommodating portion.

A seventh aspect of the invention provides a multi-polar shielded connector, wherein a water-proof rubber plug is fitted between the inner wall of each of the insertion holes and the insulating outer cover of the shielded wire.

According to the seventh aspect, a rubber plug is mounted between an inner wall of each of a plurality of insertion holes of a conductive block and an insulating outer cover of each shield wire inserted into each insertion hole, so that water is prevented from entering in an accommodating portion from therebetween.

An eighth aspect of the invention provides a mating shielded connector to which a multi-polar shielded connector is fitted and which is mounted on an equipment, comprising a mating housing having a plurality of mating terminal accommodating portions in which mating terminals conductively connecting with the plurality of terminals, respectively, are accommodated, and a mating shielded connector side shielding member provided in the mating housing, for covering the plurality of mating terminal accommodating portions in a lump to shield the mating terminals and connected portions where the mating terminals and the terminals are connected to each other and for conductively connecting with the shielding member of the multi-polar shielded connector in a state fitted with the multi-polar shielded connector According to the eighth aspect, when a mating shielded connector is fitted to a multi-polar shielded connector, mating terminals in respective mating terminal accommodating portions are conductively connected to terminals of a multi-polar shielded connector, respectively. In this state, the respective mating terminals and connected portions where the terminals and the mating terminals are conductively connected to each other are covered in a lump and shielded by a mating shielded connector side shielding member. Also, the mating shielded connector side shielding member is conductively connected to a shielding member of the multi-polar shielded connector.

Accordingly, end portions of a plurality of shielded wires and a plurality of terminals of the multi-polar shielded connector, the connected portions of the terminals and the mating terminals, and a plurality of the mating terminals are shielded in a lump by the shielding member of the multi-polar shielded connector and the mating shielded connector side shielding member.

A ninth aspect of the invention provides a mating shielded connector, wherein the mating housing comprises a cylindrical outer housing, an inner housing formed integrally with the outer housing inside thereof and having the plurality of mating terminal accommodating portions, and a flange portion formed integrally with the outer housing and the inner housing, for mounting to the equipment, and the mating shielded connector side shielding member comprises a cylindrical body for covering the plurality of mating terminal accommodating portions and a grounding piece extending from the cylindrical body to the flange portion to be held between the flange portion and the equipment and to be conductively connected thereto, thereby to be grounded.

According to the ninth aspect, when a mating shielded connector is fitted to a multi-polar shielded connector, a plurality of mating terminals are conductively connected to terminals of the multi-polar shielded connector, respectively. In this state, the respective mating terminals and connected portions of the mating terminals and the terminals conductively connected to the mating terminals are covered in a lump with the mating shielded connector side shielding member. Also, the mating shielded connector side shielding member is conductively connected to an equipment by the shielding member of the multi-polar shielded connector. Furthermore, the mating shielded connector side shielding member is conductively connected to the equipment by the grounding piece to be grounded Accordingly, the shielding member of the multi-polar shielded connector is grounded via the mating shielded connector side shielding member, so that braid wires of a plurality of shielded wires are grounded in a lump.

A tenth aspect of the invention provides a mating shielded connector, wherein each of the mating terminals comprises a cylindrical body, a fitting hole provided at one side of the cylindrical body, to which the terminal is inserted, a screw portion provided at the other side thereof, to which a terminal positioned at an end portion of an electrical wire drawn out of the equipment is screwed and fixed, and a contact piece provided in the fitting hole to conductively contact an inner wall of the fitting hole and resiliently contact the terminal.

According to the tenth aspect, when a mating shielded connector is fitted to a multi-polar shielded connector, a plurality of terminals of the multi-polar shielded connector are inserted into fitting holes of the multi-polar shielded connector, respectively, to be conductively connected to mating terminals of the mating shielded connector via contacting pieces. As a result, core wire portions of a plurality of shielded wires are conductively connected to electric wires drawn out of an equipment via the terminals and the mating terminals.

In this case, the contacting piece in the fitting hole conductively contacts an inner wall of the fitting hole and resiliently contacts the terminal so that the terminal and the mating terminal are conductively connected to each other.

BRIEF DESCRIPTION OF THE ACCOMPANYING DRAWINGS

The above and further objects and novel features of the present invention will more fully appear from the following detailed description when the same is read in conjunction with the accompanying drawings, in which.

Figure 13:
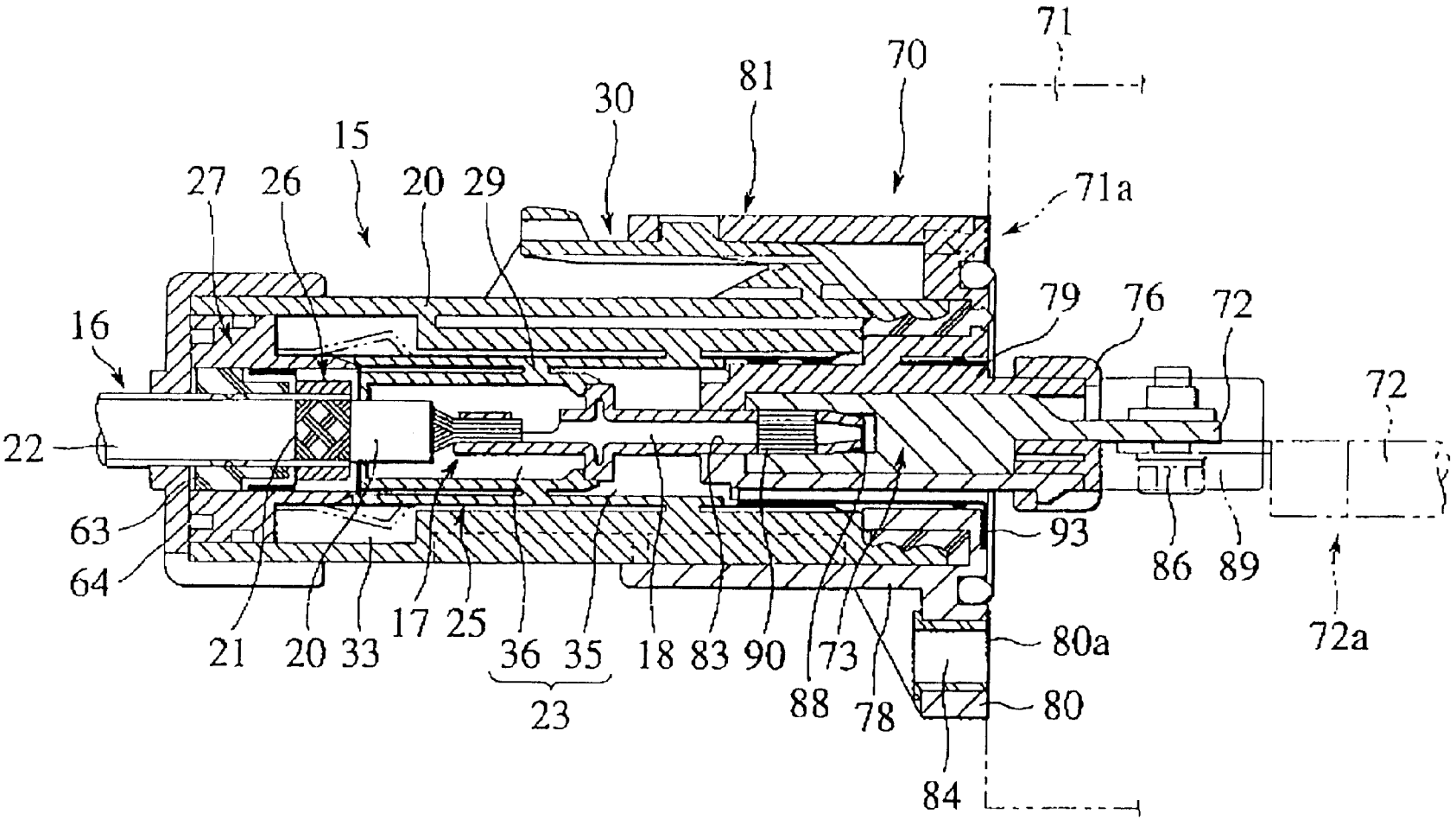
Figure 14:
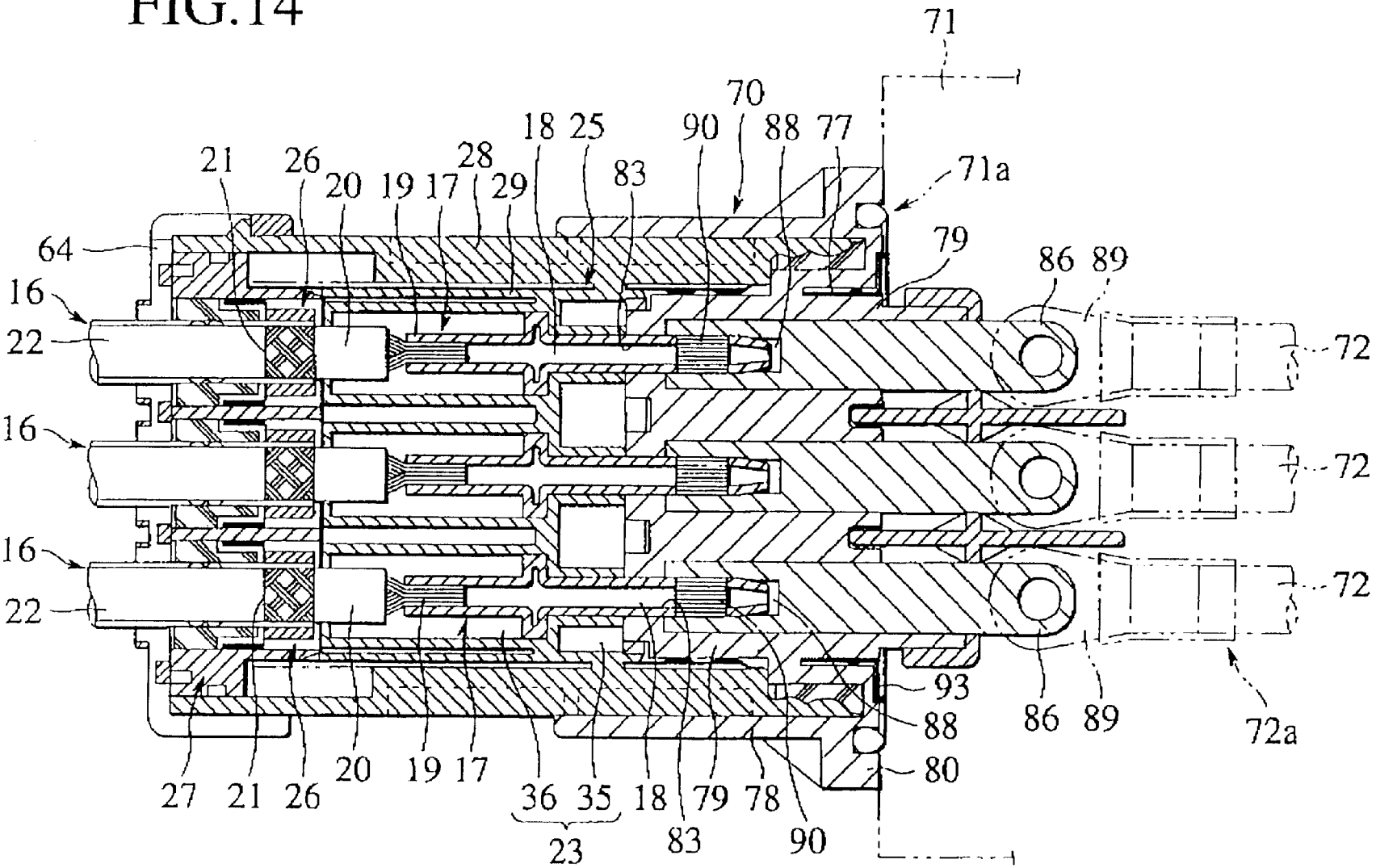

FIG. 13 is a sectional view showing insides of the multi-polar shielded connector and the mating shielded connector in a state in which the connectors are fitted to each other; and FIG. 14 is a sectional view showing insides of the multi-polar shielded connector and the mating shielded connector in a state in which the connectors are fitted to each other, taken at a position rotated 90° from the sectional view of FIG. 13.

DETAILED DESCRIPTION OF THE PREFERRED EMBODIMENTS

There will be detailed below the preferred embodiments of the present invention with reference to the accompanying drawings. Like members are designated by like reference character.

Figure 1:
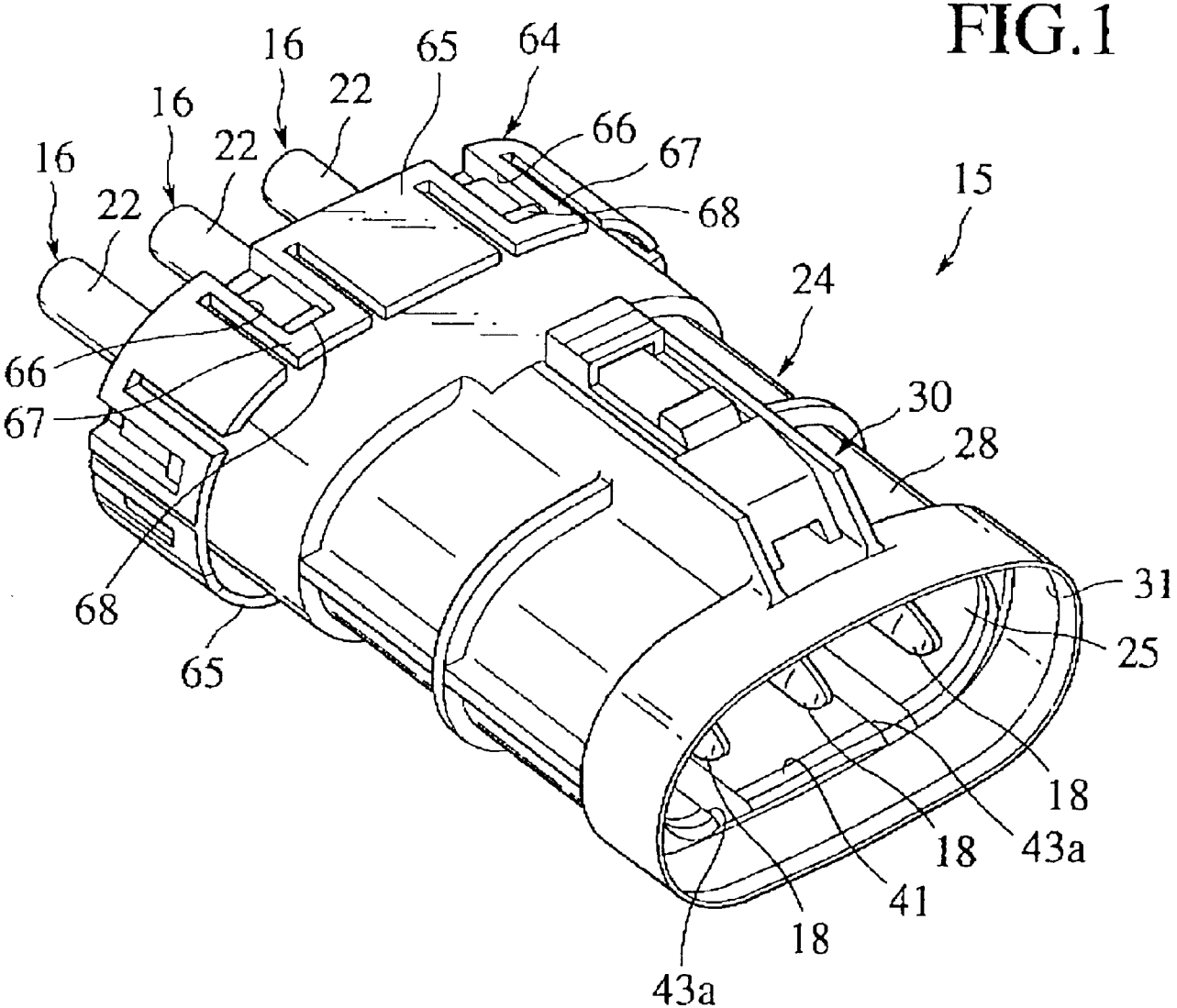
FIG. 1 is a perspective view showing an appearance of a multi-polar shielded connector according to an embodiment of the present invention.
Figure 2:
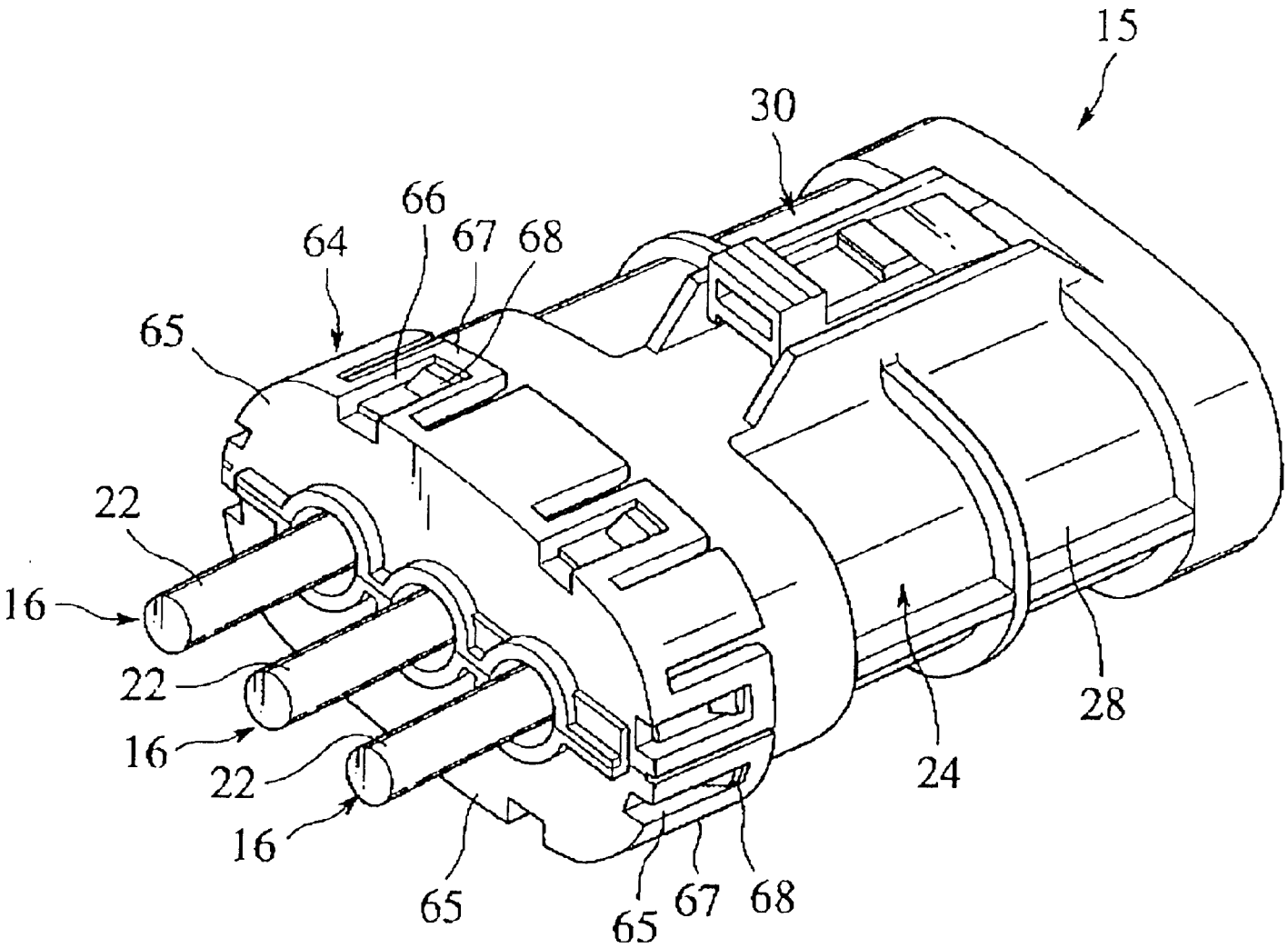
FIG. 2 is a perspective view of the appearance of the multi-polar shielded connector according to the embodiment of the present invention, viewed in a direction different from FIG. 1.
Figure 3:
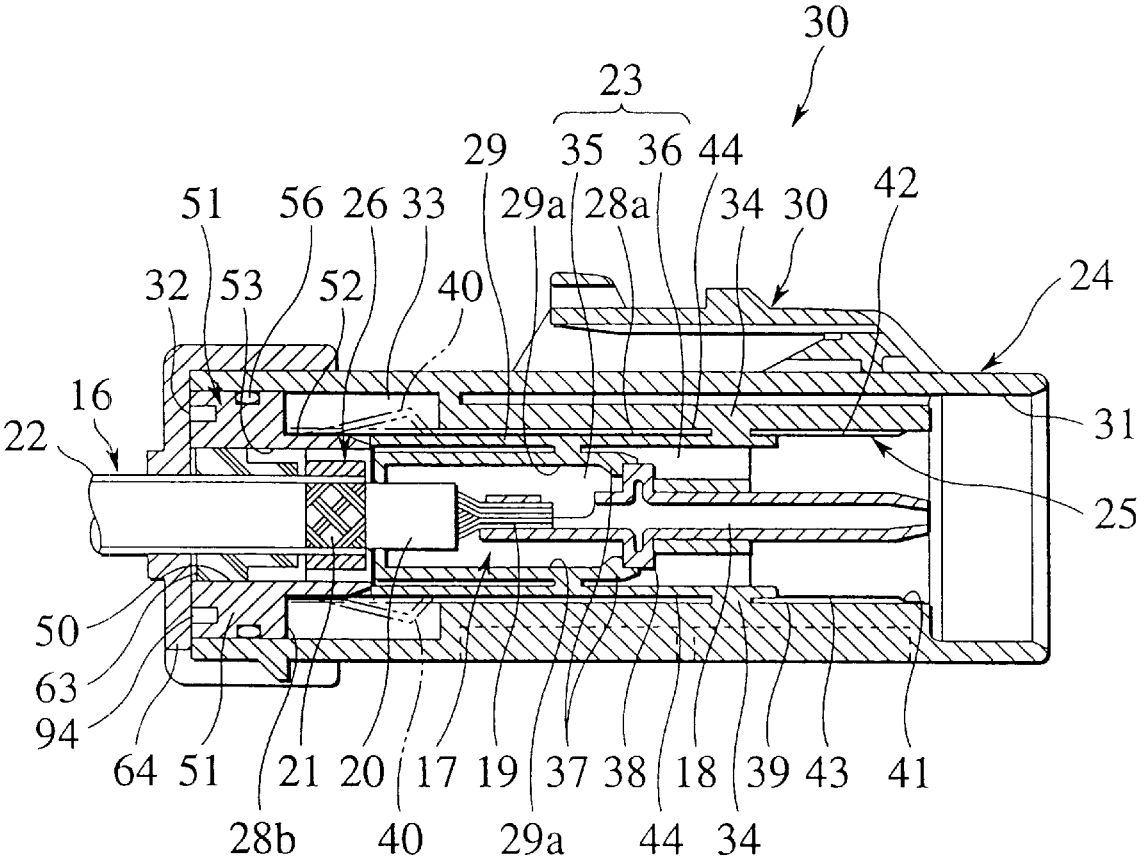
FIG. 3 is a sectional view showing an inside of the multi-polar shielded connector, taken along line III—III of FIG. 4.
Figure 4:
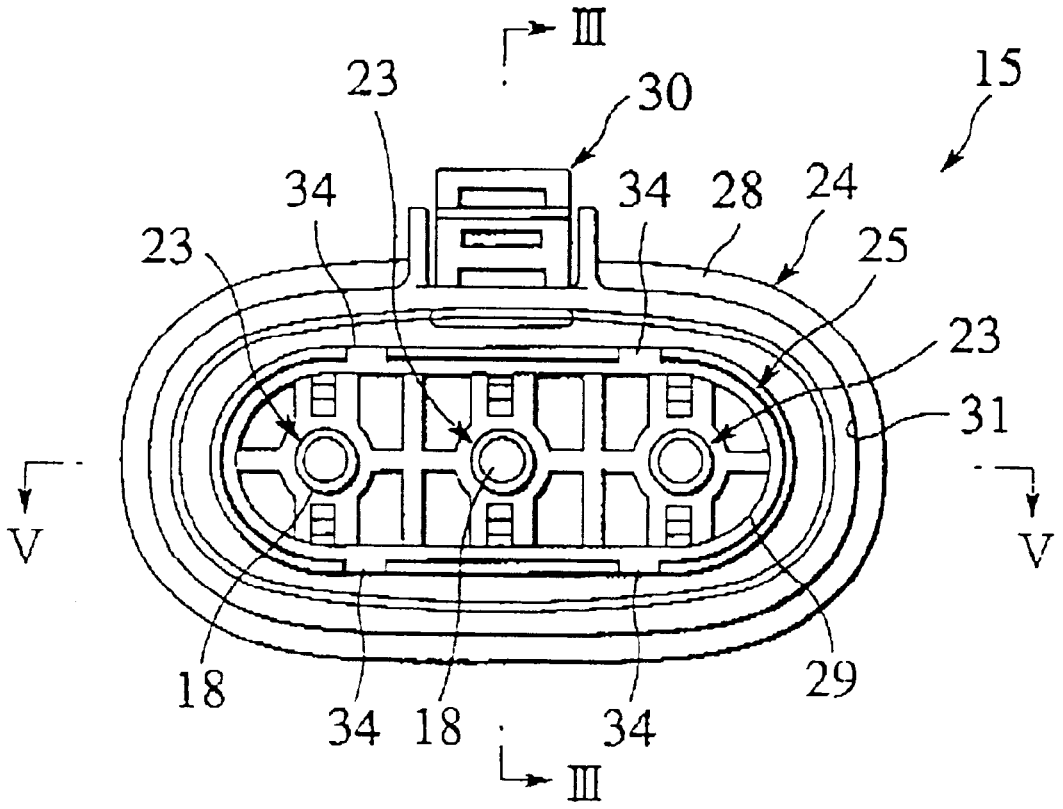
FIG. 4 is a front view showing the multi-polar shielded connector.

FIGS. 1 and 2 are perspective views showing appearances of a multi-polar shielded connector (male connector) 15, and FIG. 3 is a sectional view showing inside of the multi-polar shielded connector 15. Also, FIG. 4 is a front view of the multi-polar shielded connector 15 and FIG. 5 is a sectional view showing inside of the multi-polar shielded connector 15.

The multi-polar shielded connector 15 accommodates end portions 17 of a plurality of shielded wires 16 and terminals 18 connected to the end portions 17 in a shielded state. In this embodiment, as shown in FIGS. 3 and 5, the shielded wire 16 used comprises a core wire portion 19 comprising a conductor, an insulating inner cover 20 covering the core wire portion 19, a braid wire 21 disposed around the insulating inner cover 20, and an insulating outer cover 22 disposed around the braid wire 21 to cover the core wire portion 19, the insulating inner cover 20 and the braid wire 21.

Figure 5:
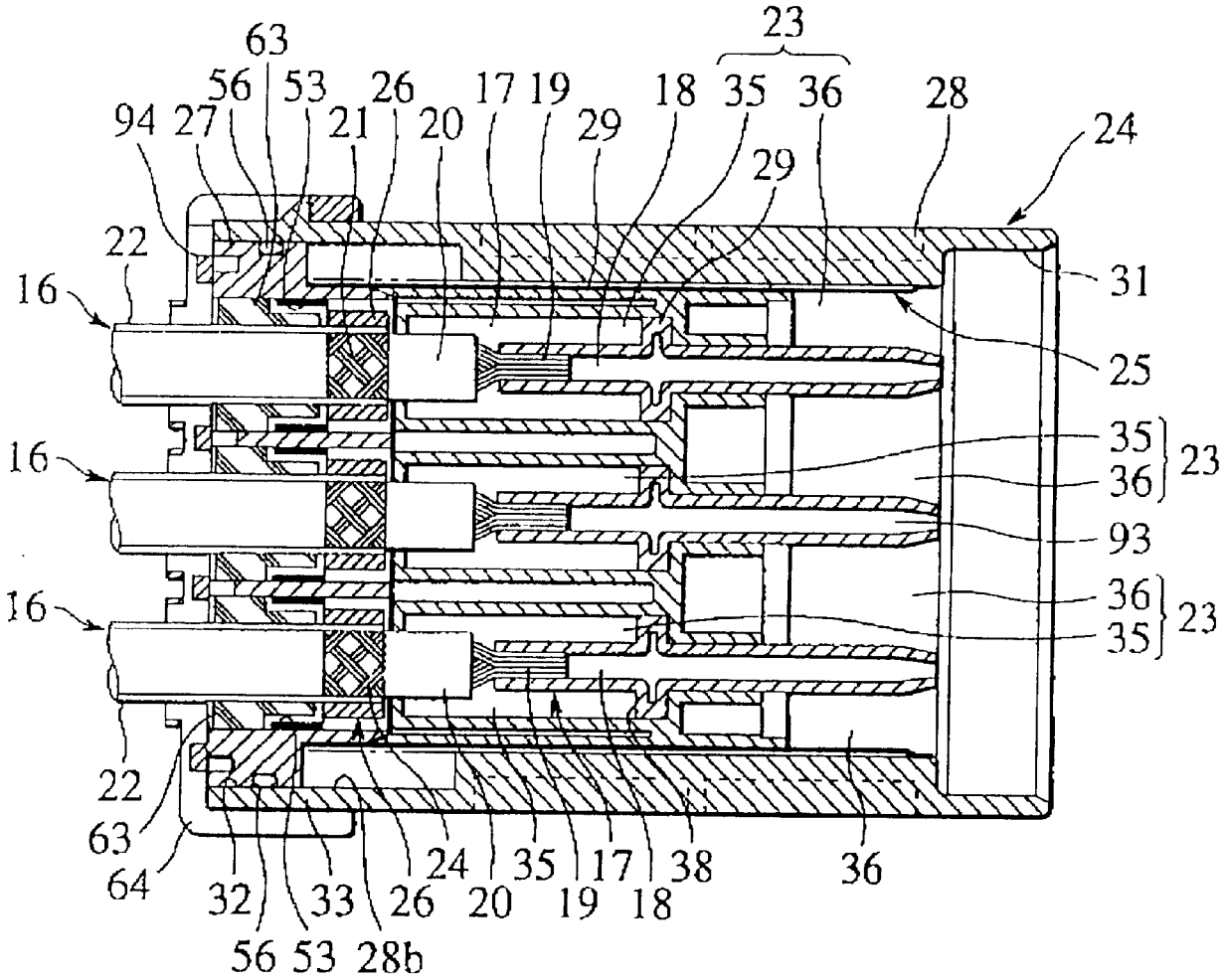
FIG. 5 is a sectional view showing an inside of the multi-polar shielded connector, taken along line V—V of FIG. 4.

Also, as shown in FIGS. 3 and 5, the multi-polar shielded connector 15 of this embodiment is provided with a housing 24 having a plurality of accommodating portions 23 where the end portions 17 of the plurality of (3 in this embodiment) shielded wires 16 together with the terminals 18 are accommodated, and a shielding member 25 disposed in the housing 24, for covering the plurality of accommodating portions 23 in a lump to shield the end portions 17 of the shielded wires 16 and the terminals 18 connected to the end portions 17. Further, the multi-polar shielded connector 15 of this embodiment includes a plurality of shield contact members 26 conductively contacting the respective braid wires 21 of the shielded wires 16, respectively, and a conductive block 27 assembled in the housing 24 to conductively connect to the shielding member 25 and to conductively connect to the shield contact members 26, thereby conducting the shielding member 25 and the shield contact members 26.

The housing 24 comprises a cylindrical outer housing 28, as shown in FIGS. 1 and 2, and an inner housing 29 provided inside of the outer housing 28 integrally therewith via a coupling portion 34 so as to have the plurality of accommodating portions 23 inside, as shown in FIGS. 3 and 5. The outer housing 28 is formed in a cylindrical configuration having an oval cross section and is provided at an outer periphery with a locking portion 30. When the multi-polar shielded connector is fitted to a mating shielded connector 70, the locking portion 30 is engaged with a mating locking portion 81 of the mating shielded connector 70 to maintain a state fitted with the mating shielded connector 70, as will be described later. Also, one opening portion 31 of the outer housing 28 serves as a fitting opening portion fitting to the mating shielded connector 70, and the other opening portion 32 thereof serves as a mounting opening portion mounted with the conductive block 27. Further, an inner space of the outer housing 28 at a side of the other opening portion 32 serves as a braid wire connection accommodating portion 33 where the shield contact members 26 are conductively connected to the braid wires 21 of the shielded wires 16, respectively.

The inner housing 29 is formed with the plurality of accommodating portions 23 inside, as shown in FIG. 5. Each of the accommodating portions 23 includes an end portion accommodating portion 35 where the end portion 17 of the shielded wire 16 is accommodated, and a terminal accommodating portion 36 where the terminal 18 of the end portion 17 of the shielded wire 16 is accommodated. The braid wire connection accommodating portion 33 is positioned to be opposed to the terminal accommodating portions 36 via the end portion accommodating portions 35. Also, as shown in FIG. 3, a pair of flexible engaging arms 37, 37 extends from an inner wall 29*a* of the inner housing 29 between the end portion accommodating portion 35 and the terminal accommodating portion 36. These flexible engaging arms 37 engage an engaging flange portion 38 to restrict movement of the terminal 18 towards the braid wire connection accommodating portion 33. The shielding member 25 is disposed outside of the inner housing 29.

The shielding member 25 comprises a cylindrical body 39 having an oval sectional configuration, provided between the outer housing 28 and the inner housing 29 to cover the end portion accommodating portions 35 and the terminal accommodating portions 36, and resilient contact pieces 40 provided in the cylindrical body 39 to resiliently abut against the conductive block 27, thereby conductively connecting therewith, and it is formed of a metal comprising a non-magnetic body.

A pair of slits 42*a*/43*a* (see FIG. 7) extending from an opening portion 41 to an intermediate portion thereof at one side of the cylindrical body 39 is formed on each of upper and lower opposite walls 42 and 43 of the cylindrical body 39. The coupling portion 34 for coupling the inner housing 29 and the outer housing 28 is inserted into these slits 42*a* and 43*a*. Also, a plurality of semi-circular projections 44 are provided at predetermined intervals on an outer periphery of an intermediate portion, in an axial direction, of the cylindrical body 3. The semi-circular projections 44 press the inner wall 28*a* of the outer housing 28 to prevent the shielding member 25 from shaking between the outer housing 28 and the inner housing 29. Furthermore, three joining portions 45, 45, 45 are formed on the upper surface (upper wall) 42 of the cylindrical body 39. The joining portions 45 join both ends of a metal plate when the metal plate is formed in a cylindrical configuration having an oval cross section Each of the resilient contacting pieces 40 is formed by bending a portion positioned between a pair of slits formed to extend from an opening portion at the other side of the cylindrical body 39. The resilient contacting piece 40 is formed with a rising piece portion 47 and a lowering piece portion 48 contiguous from the body 39 side, and a resilient abutting portion 49 for abutting against the conductive block 27 is bent to be formed at a distal side of the lowering piece portion 48. In a state where the shielding member 25 is disposed between the outer housing 28 and the inner housing 29, the one side of the cylindrical body 39 and the resilient contacting pieces 40 are positioned within the braid wire connection accommodating portion 33 and the resilient abutting portions 49 abut against the conductive block 27.

Figure 6:
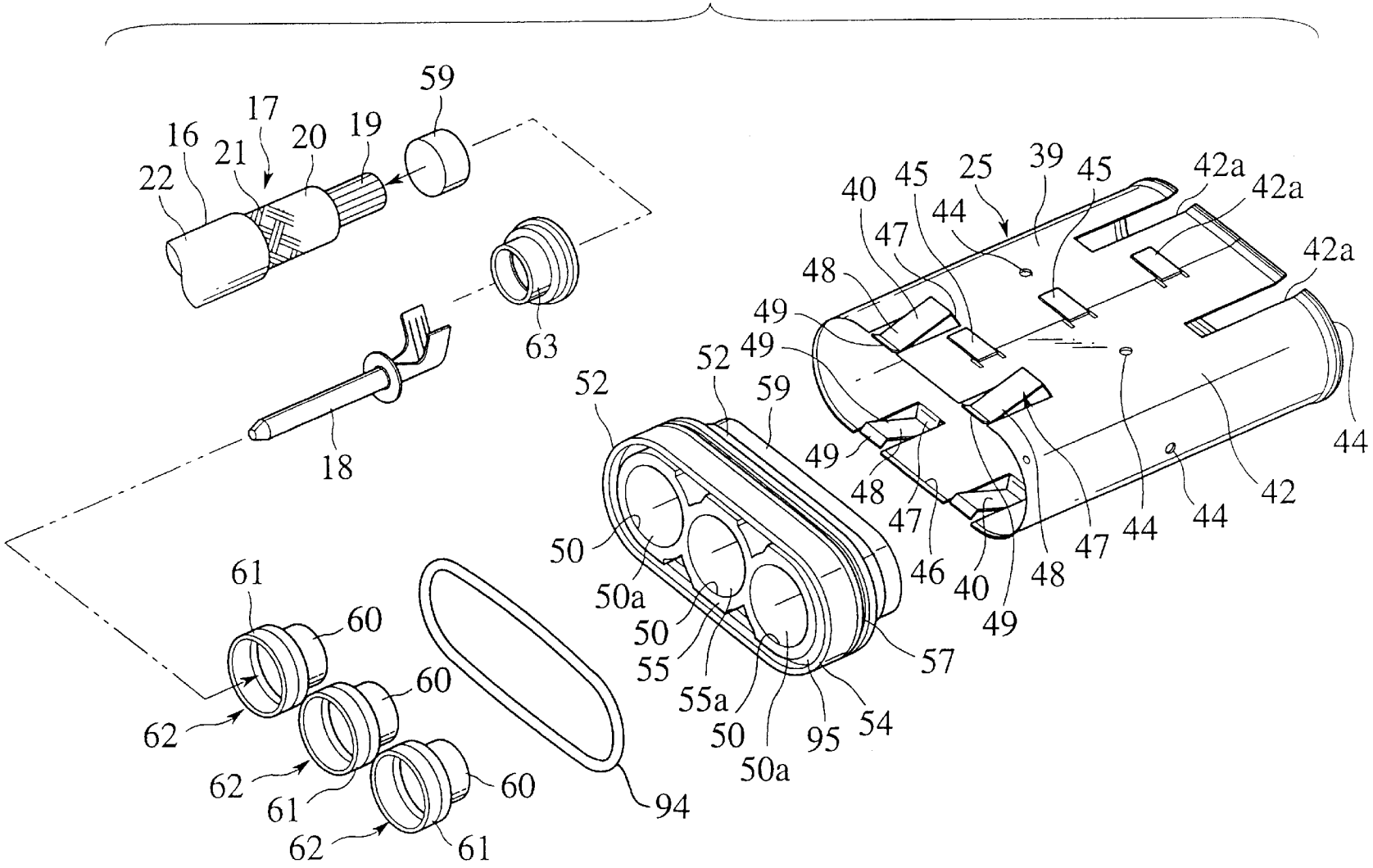
FIG. 6 is an exploded perspective view showing a shielding member, a conductive block, a shield contact member, and a shielded wire used in the multi-polar shielded connector.
Figure 7:
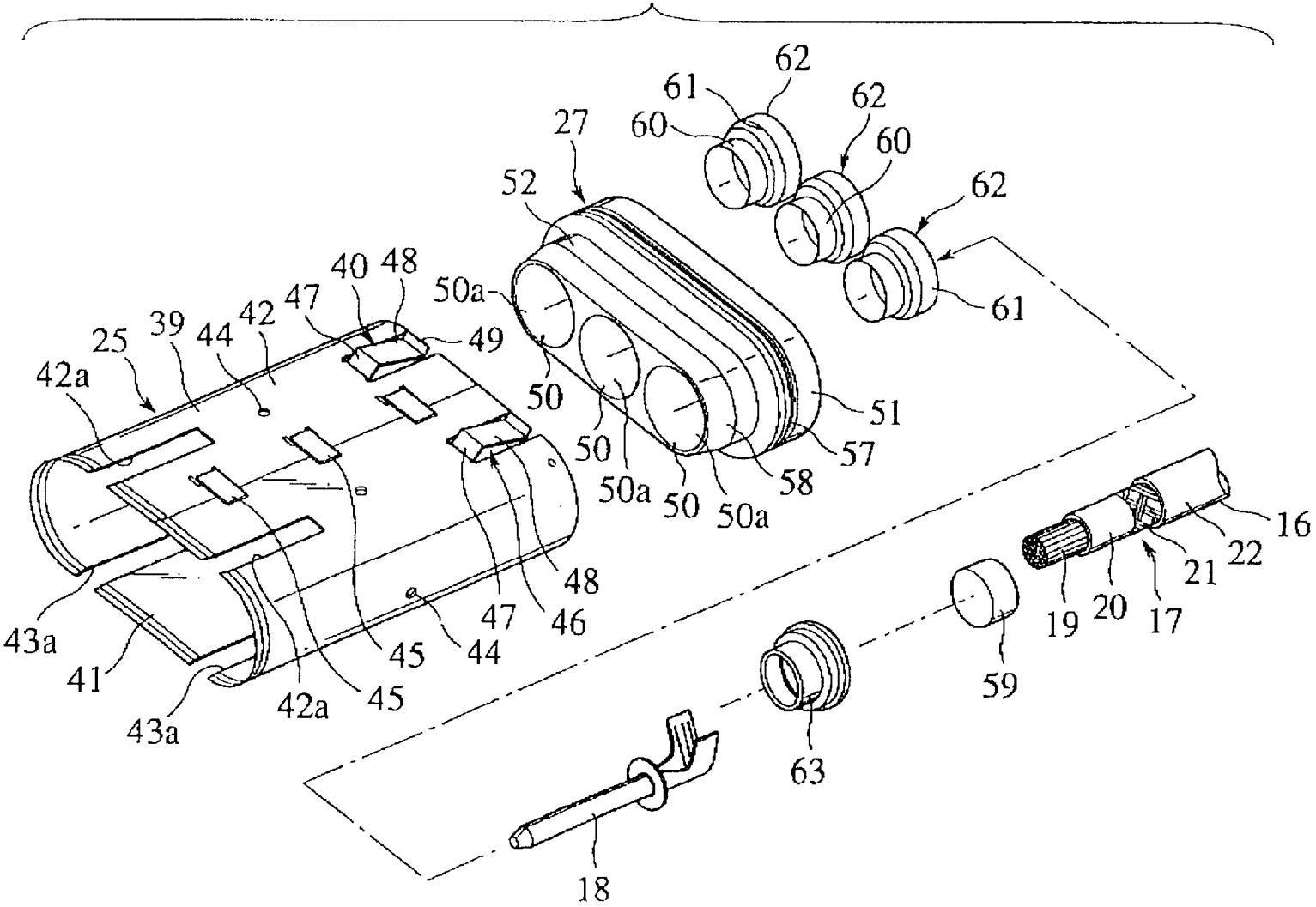
FIG. 7 is an exploded perspective view showing end portions of the shielding member, the conductive block, the shield contact member, and the shielded wire used in the multi-polar shielded connector, viewed in a direction different from FIG. 6.

The conductive block 27 is formed by plating an aluminum alloy and mounted to the opening portion 32 of the outer housing 28 at the braid wire connection accommodating portion 33 side, as shown in FIGS. 6 and 7. The conductive block 27 comprises a block body 51 having three insertion holes 50 through which the shielded wires 16 drawn out from the respective accommodating portions 23 pass, an outer peripheral connecting portion 52 formed integrally with the body 51, against which the resilient contacting pieces 40 of the shielding member 25 abut to conductively connect with the shielding member 25, and inner peripheral connecting portions 53 (see FIGS. 3 and 5) provided on the inner walls 50*a* of the insertion holes 50, respectively, which conductively contact with the shield contact members 26.

The block body 51 includes, in an integral structure, an outer cylindrical wall 54 having an oval sectional configuration and an inner wall portion 55 provided inside of the outer cylindrical wall 54, having the three insertion holes 50 formed in parallel. The inner wall portion 55 projects from one side, in an axial direction, of the outer cylindrical wall 54. A recessed groove 57 receiving an O-ring 56 fitted between the inner wall 28*b* of the outer housing 28 and the block body 51 is formed on a whole outer periphery of the outer cylindrical wall 54, and on an inner periphery of the outer cylindrical wall 54 a recessed groove 95 receiving an O-ring 94 between the inner wall portion 55 and the inner periphery is formed. An outer peripheral portion of the inner wall portion 55 which projects from the outer cylindrical wall 53 is formed with the above outer peripheral connecting portion 52. Further, a distal side of the outer peripheral portion of the inner wall portion 55 which projects from the outer cylindrical wall 54 is formed with a slanting surface 58. The outer peripheral connecting portion 52 is fitted in the opening portion 46 of the shielding member 25 to resiliently abut against the resilient contacting pieces 40 so that the conductive block 27 and the shielding member 25 is conductively connected to each other.

The shielded wires 16 drawn out from three accommodating portions 23 is inserted into three insertion holes 50 of the inner wall portion 55, respectively. Also, the inner peripheries of three insertion holes 50 serve as inner peripheral connecting portions 53 with which the shield contact members 26 conductively contact.

As shown in FIGS. 6 and 7, each of the shield contact members 26 comprises a conductive contactor pipe 59 inserted between the insulating inner cover 20 and the braid wire 21 of the shielded wire 16, and a shield contactor 62 having a braid wire connecting end 60 formed at one side to be fitted on the braid wire 21 so as to hold the braid wire 21 between the contacting pipe 59 and the braid wire connecting end 60 and a conductive block connecting end 61 formed at the other side to conductively contact with the inner peripheral contacting portion 53 of the conductive block 27. An outer diameter of the braid wire contacting end 60 is formed to be smaller than that of the conductive block connecting end 61 and it is caulked in a state where the braid wire 21 is held between the contactor pipe 59 and the contacting end 60. Also, a water-proof rubber plug 63 is mounted between the inner wall 50*a* of the insertion hole 50 and the insulating outer cover 22 of the shielded wire 16, as shown in FIGS. 3 and 5.

The braid wires 21 of the respective shielded wires 16 are conductively connected to the one conductive block 27 by the respective shield contact members 26 and they are conductively connected to the shielding member 25 in a lump by the conductive block 27.

Also, a retainer 64 is mounted to the opening portion 32 of the braid wire connection accommodating portion 33 of the outer housing 28 at a rear end side of the conductive block 27. The retainer 64 is constituted with two half cover bodies 65, as shown in FIGS. 1 and 2. The half cover bodies 65 are formed on their outer peripheries with flexible engaging frames 67 forming engaging holes 66. Engaging projections 68 provided on an outer periphery of the outer housing 28 are engaged with the engaging holes 66, so that the retainer 64 is engaged with the opening portion 32 of the outer housing 28, thereby preventing the conductive block 27 and the rubber plug 63 from falling off from the opening portion 32 of the outer housing 28.

Next, an assembling procedure of the above multi-polar shielded connector 15 will be explained. As shown in FIGS. 3 and 5, the end portion of each shielded wire 16 is formed such that the core wire portion 19, the insulating inner cover 20 and the braid wire 21 are exposed in this order, and the shielded wire 16 thus formed is previously fitted with the rubber plug 63 and the conductive block 27 and the braid wire 21 is held between the contactor pipe 59 and the shield contactor 62, so that the shield contactor 62 is conductively connected to the inner peripheral connecting portion 53 of the insertion hole 50 of the conductive block 27. Also, the terminal 18 is caulked to the core wire portion 19.

On the other hand, the shielding member 25 is assembled between the inner housing 29 and the outer housing 28, thereby covering three accommodating portions 23 in a lump. In this state, the terminal 18, the end portion 17 of the shielded wire 16 and the shielded wire 16 are inserted into the outer housing 28 from the other opening portion 32, and the terminal 18 is further inserted into the terminal accommodating portion 36. When the terminal 18 is inserted into the terminal accommodating portion 36, the flexible engaging arms 37 engages the engaging flange portion 38 of the terminal 18. In this state, the end portion 17 is positioned in the terminal accommodating portion 35.

Also, the conductive block 27 is inserted in the other opening portion 32 simultaneously with insertion of the terminal 18 in the accommodating portion 23. When the conductive block 27 is inserted into the other opening portion 32, the resilient contacting pieces 40 of the shielding member 25 are slid on the slanting surface 58 to resiliently abut against the outer peripheral connecting portion 52, thereby conductively contacting therewith. Further, the conductive block 27 is prevented from falling off from the outer housing 28 by engaging the retainer 64 with the opening portion 32 of the outer housing 28. Thus, the assembling of the multi-polar shielded connector 15 is completed.

In this state, since the shielding member 25 magnetically shields three accommodating portions 23 in a lump and the respective shield contact members 26 are connected to one conductive block 27, respectively, the braid wires 21 of the respective shielded wires 16 are conductively connected to the shielding member 25 in a lump by the conductive block 27.

Next, a multi-polar shielded connector of a mating side (a female connector, which is hereinafter referred to as "mating shielded connector") fitted with the multi-polar shielded connector 15 will be described with reference to FIGS. 8 to 11. The mating shielded connector 70 is mounted to an equipment 71 side so that terminals 72*a* of electrical wires 72 connected to the equipment 71 and the terminals 18 of the multi-polar shielded connector 15 are connected to each other and the shielding member 25 of the multi-polar shielded connector 15 is grounded to the equipment 71.

Figure 8:
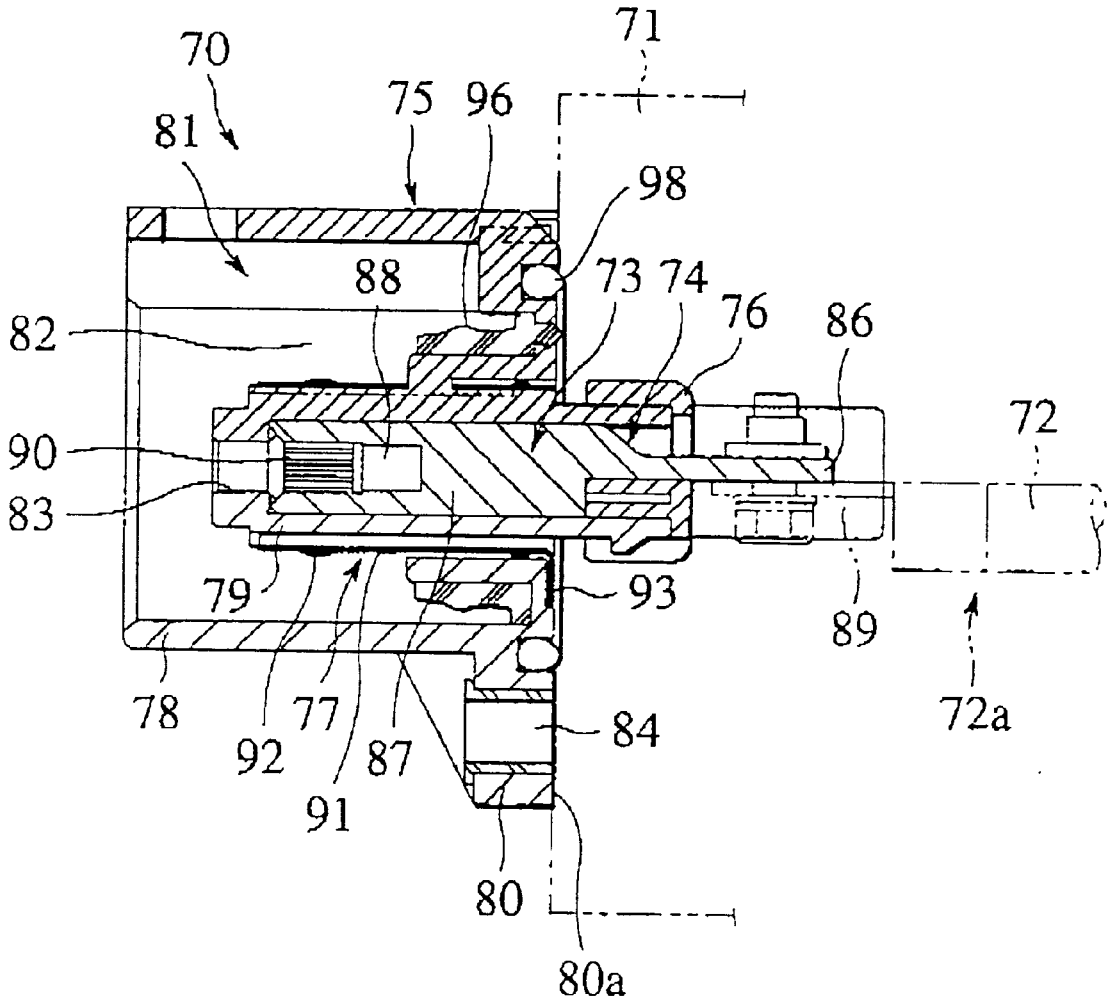
FIG. 8 is a sectional view showing an inside of a mating shielded connector fitted with the multi-polar shielded connector, taken along line VIII—VIII of FIG. 9.
Figure 9:
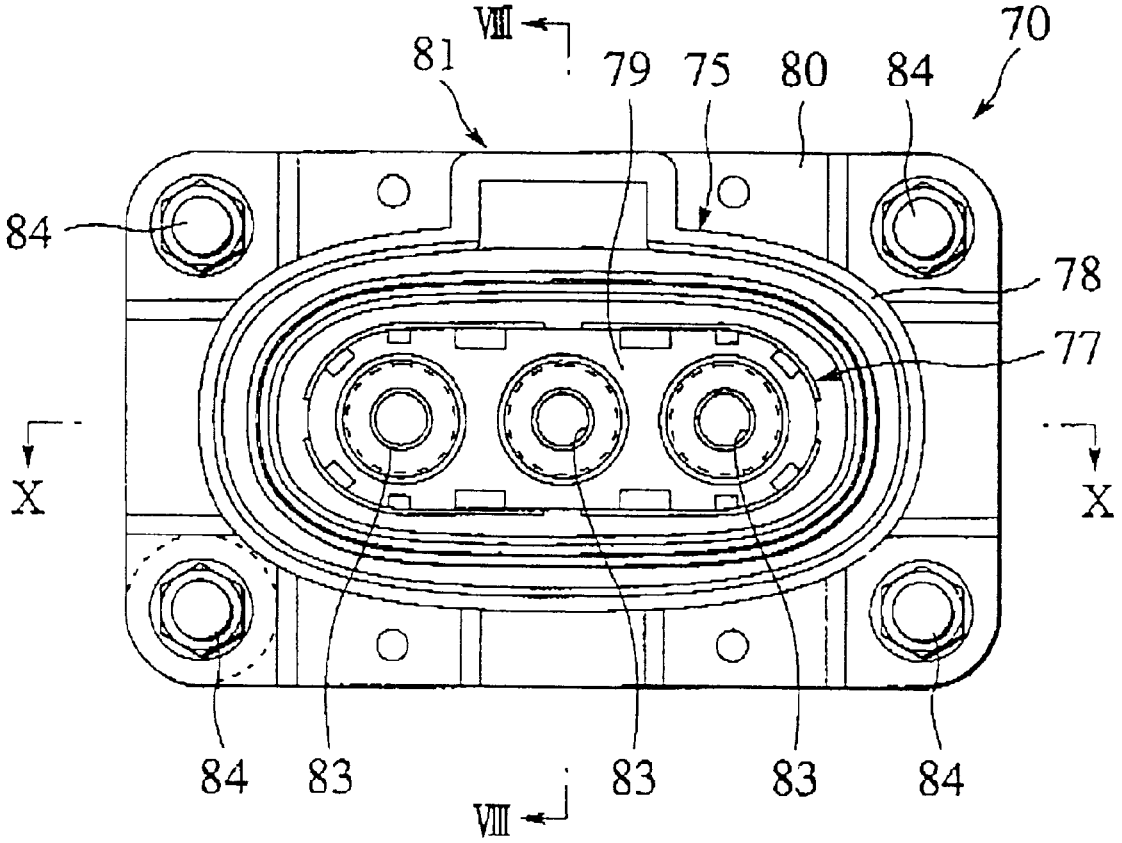
FIG. 9 is a front view showing the mating shielded connector.
Figure 10:
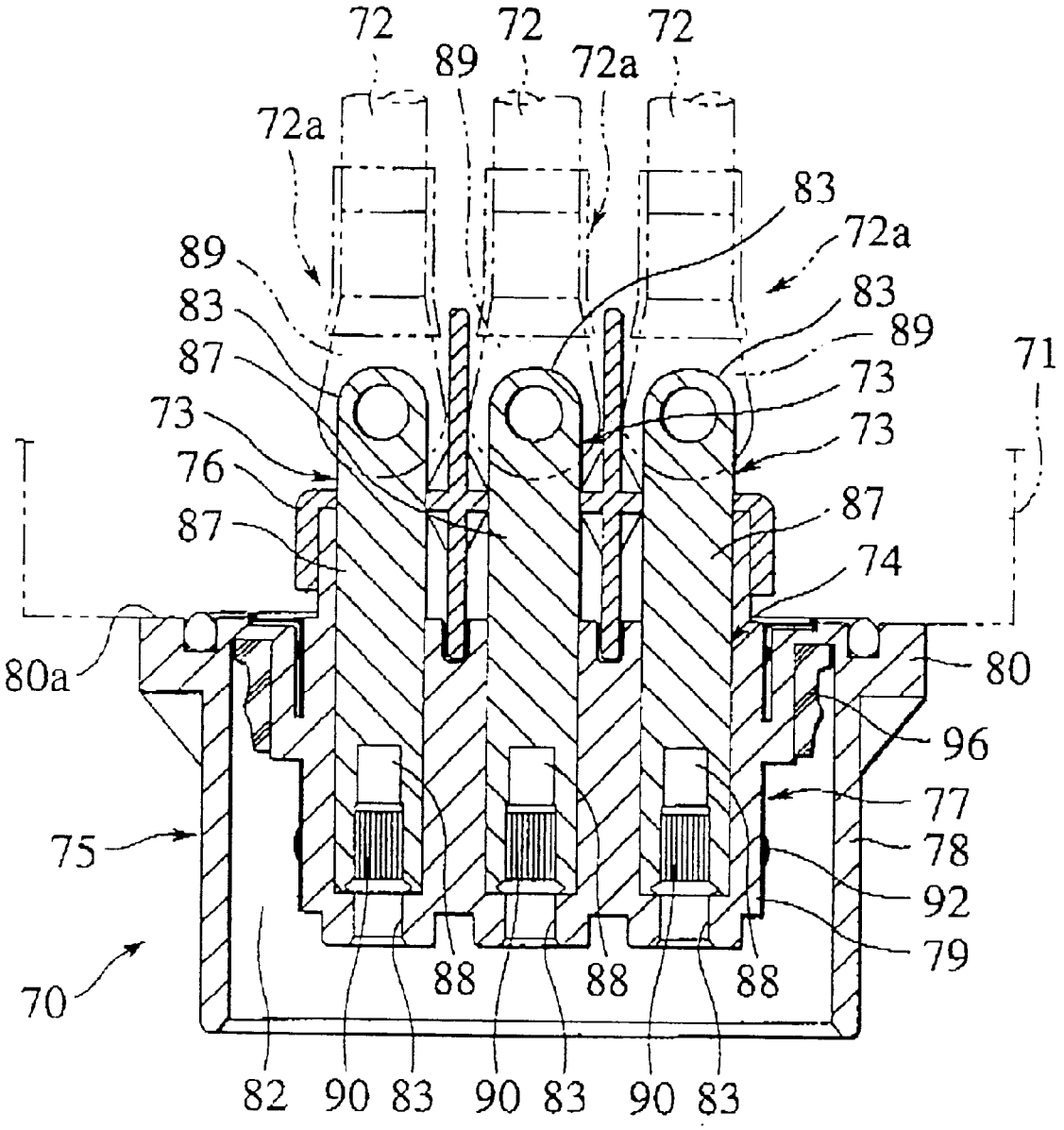
FIG. 10 is a sectional view showing an inside of the mating shielded connector, taken along line X—X of FIG. 9.
Figure 11:
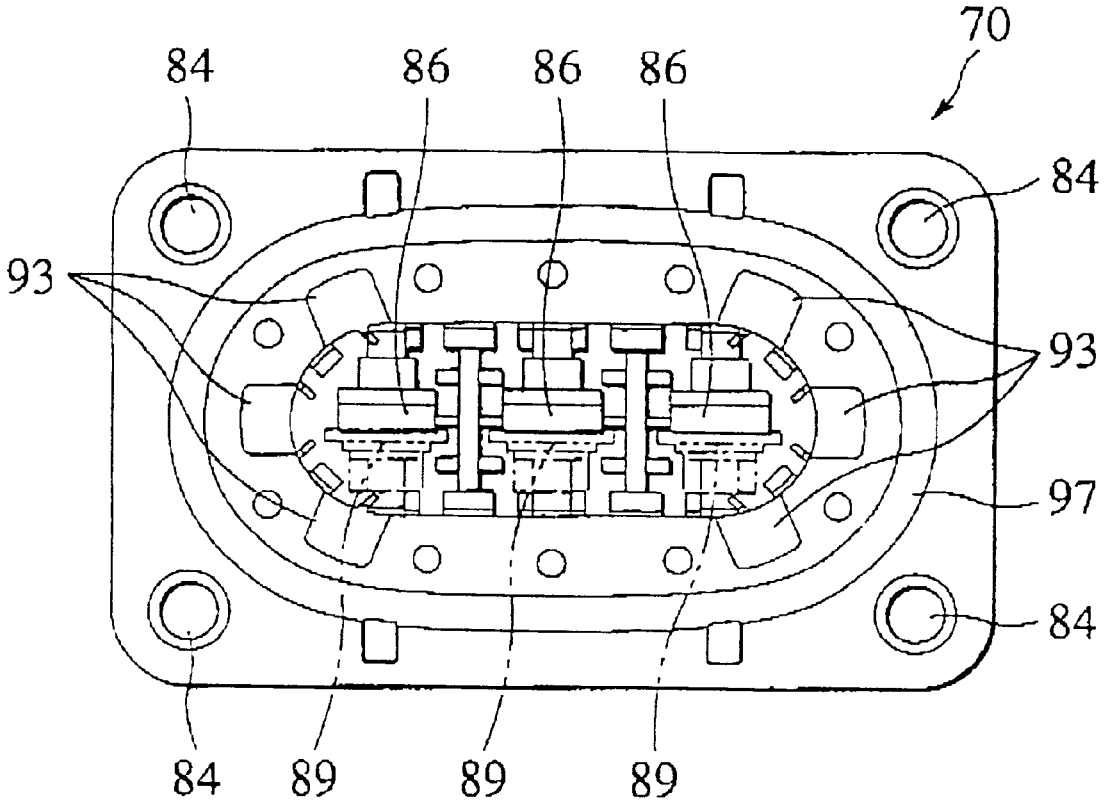
FIG. 11 is a back view showing the mating shielded connector.

As shown in FIGS. 8 to 10, the mating shielded connector 70 is provided with a female housing 75 mounted to the equipment 71 and having a plurality of (three in this embodiment) mating terminal accommodating portions 74 in which mating terminals 73 connected to the multi-polar shielded connector 15 are accommodated, respectively, the terminals 73 received in the mating terminal accommodating portions 74 of the female housing 75, respectively, a rear holder 76 for preventing the mating terminals 73 from the mating terminal accommodating portion 74, and a shielding member 77 of the mating shielded connector side provided in the female housing 75, for covering three mating terminal accommodating portions 74 in a lump and conductively connecting with the shielding member 25 of the multi-polar shielded connector 15.

Figure 12:
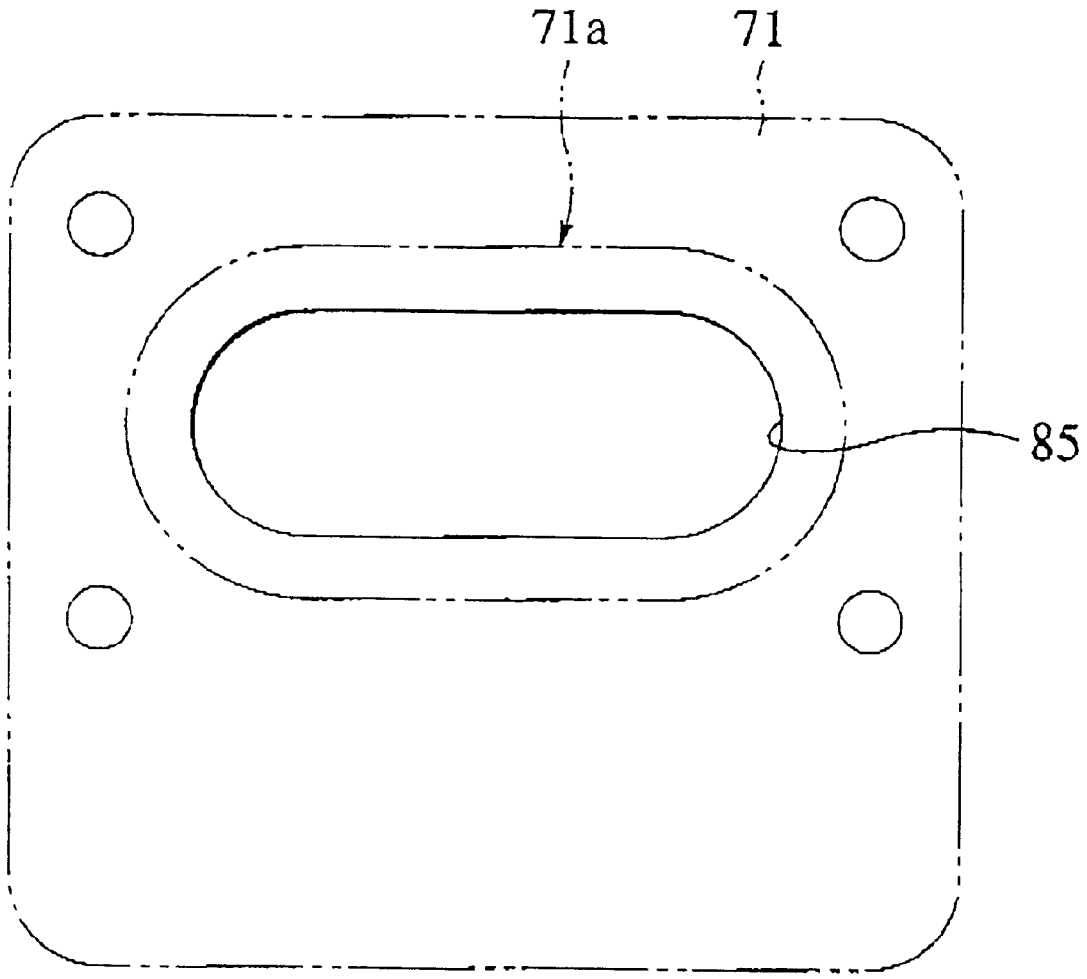
FIG. 12 is a front view showing a mounting portion of an equipment side to which the mating shielded connector is mounted.

The female housing 75 includes, in an integrated structure, a cylindrical outer housing 78 having an oval sectional configuration, an inner housing 79 in which the three mating terminal accommodating portions 74 are formed in parallel, and a flange portion 80 provided between the outer housing 78 and the inner housing 79 at their one sides to be mounted to an outer peripheral mounting portion 71*a* (refer to FIG. 12).

A portion of an outer periphery of the outer housing 78 projects outwardly to form a mating locking portion 81. The locking portion 81 engages the locking portion 30 of the multi-polar shielded connector 15 to maintain a fitting state between the multi-polar shielded connector 15 and the mating shielded connector 70. Also, between the outer housing 78 and the inner housing 79, a fitting portion 82 to which the outer housing 28 of the multi-polar shielded connector 15 is inserted and fitted is formed.

Each of the mating terminal accommodating portions 74 formed in the inner housing 79 is formed at its one side with an insertion opening portion 83 into which the terminal 18 connected to the multi-polar shielded connector 15 is inserted, and it is formed at the other side with the flange portion 80 in a projecting manner. Also, a water-proof plug 96 is mounted to the inner housing 79. The water-proof plug 96 is held closely between the outer housing 28 of the multi-polar shielded connector 15 and the inner housing 79, when the multi-polar shielded connector 15 is fitted to the mating shielded connector 70. The mating terminal 73 is inserted in the mating terminal accommodating portion 74 from the flange portion 80.

The flange portion 80 has one face opposed to the face formed with the outer housing 78 and the inner housing 79 and serving as a mounting face 80*a* to be mounted to the equipment 71. The mounting face 50*a* is formed at its four corners with screw insertion holes 84 for screwing. The mounting face 80*a* has a recessed groove 97 fitted with a sealing packing 98. The flange portion 80 is joined to a periphery of an elongated hole 85 provided in a mounting face 71*a* of the equipment 71 to be screwed thereto. At this time, a terminal screwing portion 86 of the mating terminal 73 projects from the elongated hole 85 toward the equipment 71.

The mating terminal 73 comprises a cylindrical body 87, a fitting hole 88 provided at one side of the body 87, to which the terminal 18 of the multi-polar shielded connector 15 side is fitted, and the terminal screwing portion 86 provided at the other side thereof to project from the terminal accommodating portion 74, to which the terminal 89 of the end portion 72*a* of the electrical wire 72 extending from the equipment 71 side is screwed. A contact piece 90 conductively contacting with an inner wall of the fitting hole 88 and resiliently contacting with the terminal 16 inserted in the fitting hole 88 is inserted in the fitting hole 88. The mating terminal 73 in its inserted state is prevented from falling off by the rear holder 76 mounted to the opening portion of the screwing portion 86 side. Further, the respective mating terminal accommodating portions 74 are shielded by the shielding member 77 of the mating shielded connector side covering the inner housing 79 as a whole.

The shielding member 77 of the mating shielded connector side is formed integrally with a cylindrical body 91 for covering the whole inner housing 79 to shield the three mating terminal accommodating portions 74 in a lump, a connecting end 92 provided at one side in the body 91 to conductively connect to the shielding member 25 of the multi-polar shielded connector 15, and six grounding pieces 93 extending from the mounting face 80*a* of the flange portion 80 to be conductively connected to the equipment 71.

Next, a procedure for fitting the mating shielded connector 70 to the multi-polar shielded connector 15 will be explained.

In a state where the mating shielded connector 70 is fixed to the mounting portion 71*a* of the equipment 71 by the flange portion 80, the multi-polar shielded connector 15 is moved toward the mating shielded connector 70 side to insert and fit the outer housing 28 into the fitting portion 82. When the outer housing 28 is inserted into the fitting portion 82, the terminal 18 passes through the insertion opening portion 83 to fit in the fitting hole 88 of the mating terminal 73, so that the terminal 18 is conductively connected to the mating terminal 73 via the contacting piece 90.

Also, one side of the shielded member 25 is conductively connected to the shielding member 77 of the mating shielded connector side to be grounded to the equipment 71. Therewith, the end portions 17 of the shielded wires 16 and the terminals 18 are shielded in a lump by the shielding member 25, and connecting portions between the terminals 18 and the mating terminals 73 and the mating terminals 73 are shielded by the shielding member 77 of the mating shielded connector side.

According to the multi-polar shielded connector 15 of the present embodiment, since the end portions of three shielded wires 16 and three accommodating portions 23 accommodating the terminals 18 connected to the end portions 17 are covered by the one shielding member 25 in a lump, it is unnecessary to cover the respective accommodating portions 23 with shielding members such as metallic shells, individually. As a result, it is possible to reduce the number of component parts.

Also, since a space for covering the respective accommodating portions 23 with the shielding members such as metallic shells, individually, is not required, the housing 24 is simplified in structure. Further, a plurality of shielding members such as metallic shells becomes unnecessary, which results in a small sized structure of the multi-polar shielded connector 15.

Furthermore, according to the multi-polar shielded connector 15 of this embodiment, three shield contact members 26 connected to the braid wires 21 of the respective shielded wires 16 and one conductive block 27 couductively connected to the shield contact members 26 are conductively connected to the shielding member 25, so that the respective shield contact members 26 can be conductively connected to the shielding member 26 in a lump. This shielding member 26 is grounded through the shielding member 77 of the mating shielded connector 70, so that the three shield contact members 26 can be grounded as a whole. Accordingly, since the number of conductive connected portions is reduced, the multi-polar shielded connector 15 becomes simplified in structure.

According to the mating shielded connector 70, since three mating accommodating portions 74 is covered and shielded by the shielding member 77 in a lump, it becomes unnecessary to provide metallic shells for covering the respective mating terminal accommodating portions 74, thereby resulting in reduction in the number of component parts.

While preferred embodiments of the present invention have been described using specific terms, such description is for illustrative purposes, and it is to be understood that changes and variations may be made without departing from the spirit or scope of the following claims.

What is claimed is:

1. A multi-polar shielded connector in which a plurality of shielded wires each comprising a core wire portion comprising a conductor, an insulating inner cover covering the core wire portion, a braid wire disposed around the insulating inner cover, and an insulating outer cover disposed around the braid wire for covering the core wire portion, the insulating inner cover, and the braid wire, and end portions of the plurality of shielded wires together with terminals connected to the end portions of the plurality of shielded wires are accommodated, comprising:

a housing having a plurality of accommodating portions in which the end portions of the plurality of shielded wires together with the terminals are accommodated respectively;

a shielding member provided in the housing and covering the plurality of accommodating portions as a whole to shield the end portions of the shielded wires and the terminals connected to the end portions;

a plurality of shield contact members conductively contacting the respective braid wires of the shielded wires; and a conductive block assembled in the housing to conductively connect with the shielding member and to conductively connect with the shield contact members to have the shielding member and the shield contact members conductive to each other.

2. A multi-polar shielded connector according to claim 1, wherein the housing comprises a cylindrical outer housing, and an inner housing formed integrally with the outer housing and having a plurality of the accommodating portions, each of the accommodating portions is formed with an end portion accommodating portion for accommodating the end portion of each shielded wire and a terminal accommodating portion for accommodating the terminal connected to the end portion of each shielded wire, and a braid wire connection accommodating portion formed in the outer housing at a side opposing the terminal accommodating portion via the end portion accommodating portion, where the shield contact members and the braid wires of the shielded wires are connected to each other.

3. A multi-polar shielded connector according to claim 2, wherein the shielding member comprises cylindrical body disposed between the outer housing and the inner housing, for covering the end portion accommodating portions and the terminal accommodating portions, and a resilient contacting piece provided at one side of the cylindrical body, for resiliently abutting against the conductive block to conductively connect thereto.

4. A multi-polar shielded connector according to claim 3, wherein the conductive block comprises a block body mounted to an opening of the outer housing positioned at the side of the braid wire connection accommodating portion and having a plurality of insertion holes through which the shielded wires drawn out of the respective accommodating portions pass, an outer peripheral connecting portion formed integrally with the block body against which the resilient contacting piece resiliently abuts to conductively connect with the shielding member, and inner peripheral connecting portions provided on inner walls of the insertion holes to conductively connect with the shield contact members.

5. A multi-polar shielded connector according to claim 4, wherein each of the shield contact members comprises a conductive contactor pipe inserted between the insulating inner cover and the braid wire of the shielded wire, and a shield contactor having, at one side, a braid wire connecting end which is fitted on the braid wire to hold the braid wire between the contactor pipe and the shield contactor and having, at the other side, a conductive block connecting end which conductively contacts with the inner peripheral connecting portion of the conductive block.

6. A multi-polar shielded connector according to claim 2, wherein a retainer for preventing the conductive block assembled in the outer housing from falling off from the outer housing is retained at an opening end portion of the outer housing positioned at a side of the braid wire connection accommodating portion.

7. A multi-polar shielded connector according to claim 4, wherein a water-proof rubber plug is fitted between the inner wall of each of the insertion holes and the insulating outer cover of the shielded wire.

8. A mating shielded connector to which a multi-polar shielded connector according to claim 1 is fitted and which is mounted on an equipment, comprising a mating housing having a plurality of mating terminal accommodating portions in which mating terminals conductively connecting with the plurality of terminals, respectively, are accommodated, and a mating shielded connector side shielding member provided in the mating housing, for covering the plurality of mating terminal accommodating portions in a lump to shield the mating terminals and connected portions where the mating terminals and the terminals are connected to each other and for conductively connecting with the shielding member of the multi-polar shielded connector in a state fitted with the multi-polar shielded connector.

9. A mating shielded connector according to claim 8, wherein the mating housing comprises a cylindrical outer housing, an inner housing formed integrally with the outer housing inside thereof and having the plurality of mating terminal accommodating portions, and a flange portion formed integrally with the outer housing and the inner housing, for mounting to the equipment, and the mating shielded connector side shielding member comprises a cylindrical body for covering the plurality of mating terminal accommodating portions and a grounding piece extending from the cylindrical body to the flange portion to be held between the flange portion and the equipment and to be conductively connected thereto, thereby to be grounded.

10. A mating shielded connector according to claim 9, wherein each of the mating terminals comprises a cylindrical body, a fitting hole provided at one side of the cylindrical body, to which the terminal is inserted, a screw portion provided at the other side thereof, to which a terminal positioned at an end portion of an electrical wire drawn out of the equipment is screwed and fixed, and a contact piece provided in the fitting hole to conductively contact an inner wall of the fitting hole and resiliently contact the terminal.

* * * * *